US005491280A

United States Patent [19]

Brummond et al.

[11] Patent Number: 5,491,280

[45] Date of Patent: Feb. 13, 1996

[54] INJECTOR NOZZLE FOR MOLTEN SALT DESTRUCTION OF ENERGETIC WASTE MATERIALS

[75] Inventors: William A. Brummond, Livermore; Ravindra S. Upadhye, Pleasanton, both of Calif.

[73] Assignee: Regents of the University of California, Oakland, Calif.

[21] Appl. No.: 84,633

[22] Filed: Jun. 29, 1993

[51] Int. Cl.[6] ..... C06B 21/00

[52] U.S. Cl. ..... 588/202; 588/201

[58] Field of Search ..... 588/201, 202, 588/203; 110/346, 347, 237; 239/132.3, 423

[56] References Cited

U.S. PATENT DOCUMENTS

| | | | |
|---|---|---|---|
| 3,017,256 | 1/1962 | Richardson | 422/111 |
| 3,778,320 | 12/1973 | Yosim et al. | 149/109.2 |
| 4,145,396 | 3/1979 | Grantham | 423/22 |
| 4,351,819 | 9/1982 | Riegel et al. | 423/488 |
| 4,447,262 | 5/1984 | Gay et al. | 75/65 R |
| 4,602,574 | 7/1986 | Bach et al. | 110/346 |
| 4,655,839 | 4/1987 | Chao et al. | 106/105 |
| 4,946,475 | 8/1990 | Lipp et al. | 48/86 R |
| 4,992,567 | 2/1991 | Meyer et al. | 549/532 |
| 5,346,133 | 9/1994 | Bogner et al. | 239/132.3 |

OTHER PUBLICATIONS

Upadhye et al., "Destruction of High Explosives and Wastes Containing High Explosives Using the Molten Salt Destruction Process", 23rd International Annual Conference of ICT: Waste Management of Energetic Materials and Polymers, Jun. 30–Jul. 3, 1992, Karlsruhe, Germany, UCRL–JC–109564 (released to OSTI on Oct. 29, 1992).

*Primary Examiner*—Ngoclan Mai

*Attorney, Agent, or Firm*—Daryl S. Grzybicki; Henry P. Sartorio

[57] ABSTRACT

An injector nozzle has been designed for safely injecting energetic waste materials, such as high explosives, propellants, and rocket fuels, into a molten salt reactor in a molten salt destruction process without premature detonation or back burn in the injection system. The energetic waste material is typically diluted to form a fluid fuel mixture that is injected rapidly into the reactor. A carrier gas used in the nozzle serves as a carrier for the fuel mixture, and further dilutes the energetic material and increases its injection velocity into the reactor. The injector nozzle is cooled to keep the fuel mixture below the decomposition temperature to prevent spontaneous detonation of the explosive materials before contact with the high-temperature molten salt bath.

8 Claims, 2 Drawing Sheets

INJECTOR NOZZLE FOR MOLTEN SALT DESTRUCTION OF ENERGETIC WASTE MATERIALS

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to the injection of energetic waste materials, such as high explosives, propellants, and rocket fuels, into a molten salt reactor for destruction. In particular, a cooled, insulated injector nozzle provides continuous injection of a fuel mixture into the molten salt without premature detonation or back burn.

2. Description of Related Art

The development of environmentally acceptable methods for treatment and disposal of large quantities of high explosives (HE) and other energetic materials is a growing concern and a research goal of industry and federal laboratories. Current methods for disposal of energetic waste include open-pit burning, incineration, and detonation. These methods of bulk destruction generate hazardous products from the incomplete combustion of organic material. Safe methods must be devised that can completely combust or treat hazardous and mixed wastes in waste-processing plants.

Molten salt destruction (MSD) processes have been demonstrated for wastes containing highly explosive material. Anti-Pollution Systems, Inc. originally developed MSD as a single stage process for destruction of organic wastes. The MSD process works well with pure hydrocarbons and those contaminated with inorganic compounds. MSD fully converts the organic constituents of the waste into non-hazardous compounds such as carbon dioxide, nitrogen, and water. Inorganic contaminants remain captive in the molten salt. In the case of mixed waste, the actinides in the waste are retained in the molten salt while the organic compounds are removed, thus converting the mixed waste into solely radioactive waste. The molten salt is changed periodically, and the inorganic contaminants and pure salt may be reclaimed.

The conventional MSD process is not adapted for energetic materials, which are addressed by the present invention. Energetic materials present a danger when being injected into the melt, and therefore cannot be injected directly as in the conventional method. The fuel must be handled carefully and metered into the molten bath at a temperature below the energetic release threshold. Otherwise, severe damage to the injection system and even the reaction vessel is possible, caused by violent decomposition and oxidation reactions. Since these energetic materials already contain their own source of oxygen, eliminating the gas flow in the oxidant injection system cannot be used to retard the rapid reaction and back burn. A method is needed to safely inject explosive material into a high temperature molten salt bath without premature detonation.

SUMMARY OF THE INVENTION

The present invention is a method and an injector nozzle for injecting energetic materials, such as high explosives, propellants, and rocket fuels, into a molten salt reactor. The nozzle rapidly injects a safe mixture of the energetic material with a carrier gas into the molten salt reactor. The energetic material is either diluted with a fluid diluent or mixed with a solid diluent and heated to form a safe, fluid fuel mixture. The diluent may be an organic or inorganic compound, and may be the same salt that is used in the reactor. The dilution of energetic material serves two purposes: to create an easily handled fluid form to inject into the reactor, and to prevent back burn or propagation from reactions in the molten salt bath.

An injector nozzle has been designed to keep the fluid fuel mixture cool until contact with the molten salt and to prevent premature detonation of the energetic material. The fluid fuel mixture is fed into an aspirator and dispersed with an inert carrier gas, such as nitrogen, to form droplets. The droplets are injected rapidly through a center tube into the molten salt bath. The center tube is cooled and insulated, and the temperature of the fuel mixture is kept below the temperature needed for decomposition of the energetic material.

The fluid fuel mixture is injected quickly into the molten salt reactor, where the combustible organic components of the waste react with oxygen to produce gaseous waste products such as carbon dioxide, nitrogen, and water vapor. The waste gases are removed from the reactor and may be filtered before being released to the atmosphere. The inorganic components, in the form of ash, are captured in the molten salt bath as a result of wetting and dissolution of the ash.

DETAILED DESCRIPTION OF THE INVENTION

The present invention is a method and an injector nozzle for injecting energetic materials, including high explosives, propellants, and rocket fuels, into a molten salt reactor. The invention provides a safe method for quickly injecting highly combustible or explosive material into a high-temperature salt bath, where decomposition and destruction of the organic material takes place. The insulated injector nozzle disperses a fuel mixture with an inert carrier gas and injects the droplets into the molten salt while maintaining the mixture at a temperature below the decomposition threshold.

Figure 1:
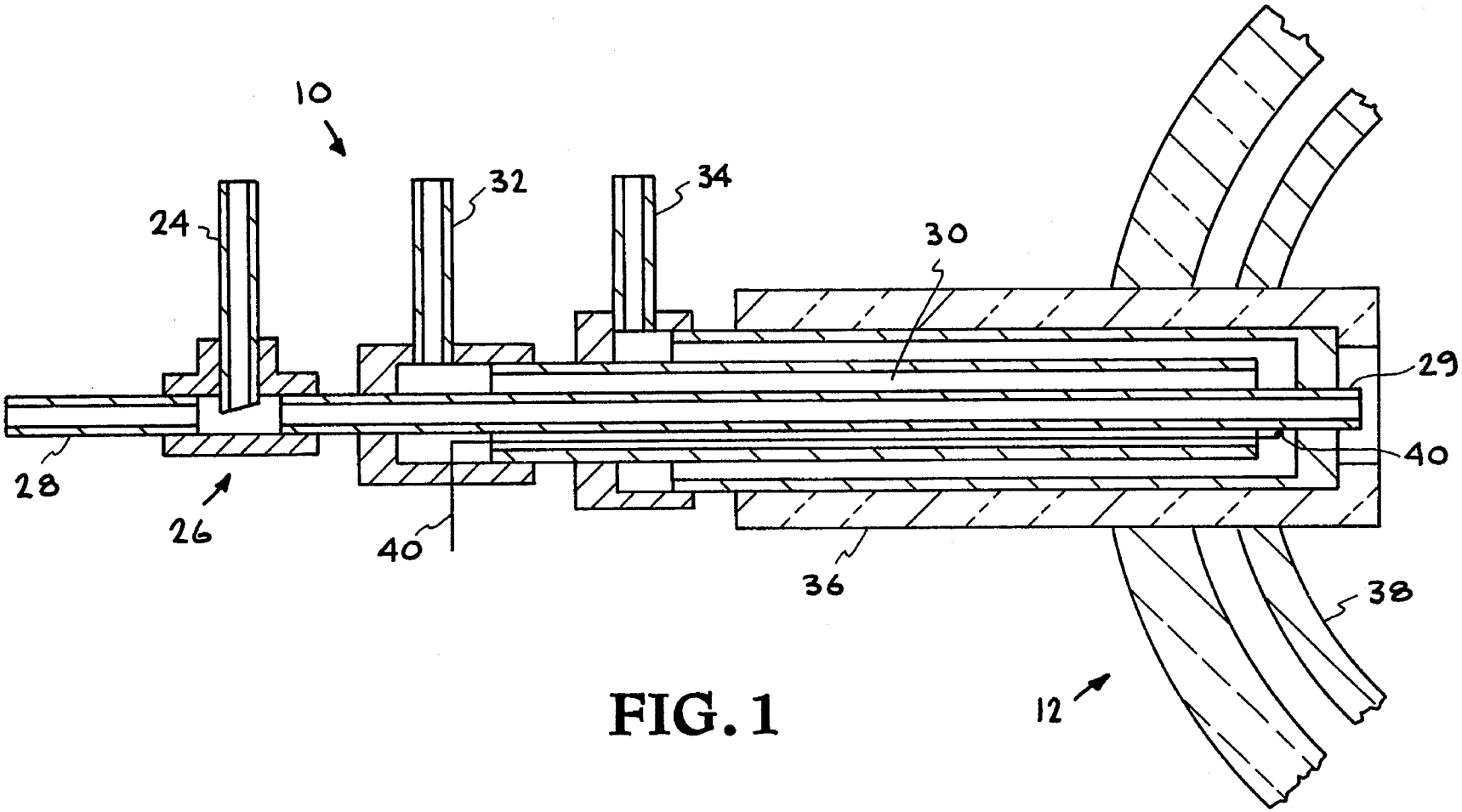
FIG. 1 is a top view of an injector nozzle according to the present invention.
Figure 2:
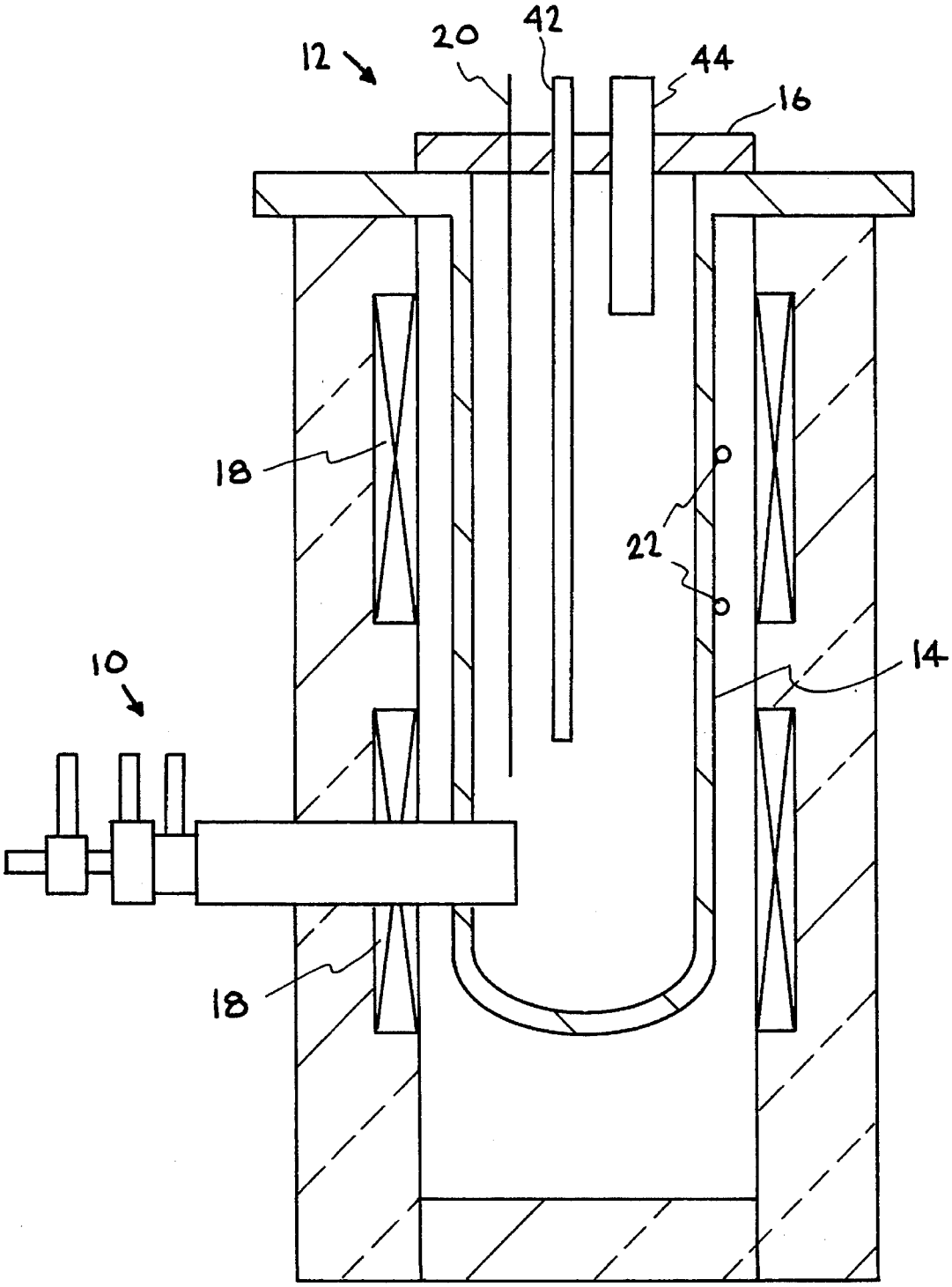
FIG. 2 shows an injector nozzle mounted on the side of a molten salt reactor for side stream injection of a fuel mixture.

FIG. 1 is a top view of the injector nozzle 10, and FIG. 2 shows the nozzle 10 mounted on a molten salt reactor 12. Safety is the major consideration in a process where wastes containing explosive material are destroyed, so the injector nozzle 10 has been designed to reduce the probability of back burn during introduction of the fuel mixture to the melt.

FIG. 2 shows a reactor vessel 14 fitted with a flange 16 on top and a removable injector nozzle 10 on the side. Conventional heating elements 18 are used to heat the vessel 14 and the salt contained therein. Cooling means (not shown) may be provided to remove the heat of reaction from the reactor 12 to prevent overheating. Thermocouples 20,22 may be placed at various locations inside and on the vessel 14 to monitor the temperature.

To begin processing, a salt or salt eutectic mixture is introduced to the vessel 14 from the top, and the top flange 16 is secured. The molten salt used in the reactor is usually chosen from carbonates, sulfates, or halides of alkali metals or alkaline earth metals; typically, the molten salt is a eutectic mixture of two or more salts. The salts provide excellent heat transfer and reaction media and catalyze the oxidation of organic compounds. The salts also neutralize acid gases such as hydrogen chloride by forming stable salts like sodium chloride. The relatively high thermal inertia of the melt tends to resist changes in temperature resulting from sudden changes in the feed or heat transfer.

The energetic material, which typically comprises high explosives, propellants, or rocket fuels, is first blended with a diluent in known proportions to form a fuel mixture. The energetic material is typically in a pulverized form and is blended with a liquid or solid diluent. The diluent may be organic, such as mineral oil, or may be inorganic, such as water or a salt.

The diluent provides a vehicle for handling the high energy material by making the material flowable and keeps the concentration of energetic material to a safe dilution level. A minimum dilution factor is needed for safe introduction of the energetic material into the molten salt bath without detonation or burning. The amount of dilution is dependent on a number of variables, including the physical and chemical nature of the injection system, the composition of the energetic fuel, and a combination of theoretical and experimental considerations. The dilution level is determined experimentally in specially designed equipment.

The fluid fuel mixture is injected into the molten salt bath through the injector nozzle 10 shown in FIG. 1. The fuel mixture may be metered into the nozzle 10 by either small batch loading or as a continual feed. The fuel mixture is first fed through a feed tube 24 into an aspirator 26. An inert carrier gas, such as nitrogen or argon, is fed through a tube 28 into the aspirator 26 as a carrier for the fuel mixture and to prevent molten salt from the reactor 12 from entering the nozzle 10. The carrier gas entrains droplets of the fuel mixture, dispersing and sweeping them through a center tube 29 of the injector nozzle 10. The particles of energetic material cannot be in a solid stream, but must be separated or diluted so that burning does not propagate in the nozzle 10.

The carrier gas has two other purposes: to insure that the droplets have a very short residence time in the nozzle 10 to prevent excessive heat build-up in the fuel mixture, and to evenly distribute the mixture into the molten salt bath to promote uniform destruction of the energetic material. The carrier gas dilutes the fuel mixture, provides additional heat capacity, and keeps the velocity of the mixture inside the nozzle 10 relatively high. As a result of these conditions, the energetic material burns only inside the reactor and not in the nozzle 10. The high injection velocity helps to maintain good turbulence and mixing inside the reactor 12.

The injector nozzle 10 is actively cooled during operation by a coolant gas (or fluid) such as air. The cooling air is circulated through a pathway 30 in the nozzle 10 around the center tube 29, passing through an inlet 32 and an outlet 34. The center tube 29 and cooling pathway 30 are contained within an injector housing 36, which is connected to the vessel wall 38 of the reactor 12. The housing 36 contains insulation, which surrounds the nozzle 10 to keep the fuel mixture below the decomposition temperature until in direct contact with the molten salt bath. The temperature of the center tube 29 near the tip next to the reactor 12 (injection point) is monitored by a thermocouple 40.

The rate of fuel injection is controlled by varying the back pressure on the fuel mixture as the fuel enters the aspirator 26, and by controlling the flow rate of the carrier gas. These two parameters can be used to accommodate different viscosity fuels. A continuously operating pump may also be used to pump the fuel into the nozzle, in which case, the speed of the pump and the carrier gas flow rate are the two important variables. The flow of coolant gas in the nozzle 10 is controlled so as to maintain a nozzle temperature below the decomposition temperature for the corresponding energetic material.

When the temperature of the molten salt in the reactor 12 is high enough to promote decomposition of the energetic material (about 400° C.–900° C.), the fluid fuel mixture is injected with the carrier gas through the injector nozzle 10 into the reactor 12. Although the energetic materials contain their own source of oxygen, an oxidant gas, such as oxygen or air, may be introduced from an external source into the molten salt through a tube 42 near the center of the reactor 12 to further stimulate oxidation reactions.

When the fuel mixture is exposed to the molten salt bath, the organic compounds undergo decomposition reactions to form waste gases such as carbon dioxide, nitrogen, and water (steam). The gaseous products of the reactions are sent to an exhaust gas outlet 44, and the temperature at the outlet 44 may be monitored by a thermocouple (not shown). The exhaust line 44 typically has a demister to trap entrained liquid salt droplets. Any inorganic impurities remain captive in the molten salt.

Applicants have successfully and safely destroyed a slurry of over 35 wt % of a typical high explosive material, HMX (octahydro-1,3,5,7-tetranitro-1,3,5,7-tetrazocine), in mineral oil. The mineral oil keeps the HMX concentration to a safe dilution level and provides a vehicle for handling the HMX. HMX contains sufficient oxygen (from nitro groups) to propagate a steady back burn without any additional oxygen.

The gas samples obtained during operation of the system were analyzed, and qualitative observations were made. First, no hydrogen cyanide (HCN) was found in the exhaust, indicating that this acid gas was neutralized by the alkaline carbonate, probably producing sodium cyanide (NaCN). Molten salts are known to be effective scrubbing agents for acid gases. Second, the amount of carbon monoxide was relatively small, indicating that the major combustion products are nitrogen, water, and carbon dioxide. The salt samples were analyzed for traces of the high explosive, HMX, to determine the extent of destruction; no HMX or decomposition products were detected in the salt to a sensitivity of 5 ppm.

Essentially similar experiments have been successfully completed with similar results for other high explosives such as RDX (hexahydro-1,3,5-trinitro -1,3,5-triazocine), PETN (2,2-Bis[{nitrooxy} methyl]-1,3-propanediol dinitrate), and TATB (2,4,6-trinitro-1,3,5-benzene triamine), and on a liquid gun propellant comprising HAN (hydroxyammonium nitrate) and TEAN (triethanol ammonium nitrate). Applicants have demonstrated that highly energetic materials can be safely and completely destroyed using the molten salt destruction process.

The foregoing description of preferred embodiments of the invention is presented for purposes of illustration and description and is not intended to be exhaustive or to limit the invention to the precise form disclosed. Many modifications and variations are possible in light of the above teaching.

We claim:

1. A method for safely injecting an energetic material into a reactor containing a molten salt bath for destruction of the energetic material, comprising:

(a) mixing the energetic material and a diluent to form a fuel mixture;

(b) adding a carrier gas to the fuel mixture;

(c) forming droplets of the carrier gas and fuel mixture;

(d) cooling the droplets;

(e) maintaining the temperature of the droplets below the decomposition temperature of the fuel mixture; and (f) injecting the droplets into the molten salt bath.

2. The method as recited in claim 1, further including:

forming a fluid fuel mixture by blending the energetic material and the diluent in a ratio below the decomposition threshold of the energetic material.

3. The method as recited in claim 1, wherein the energetic material is selected from the group consisting of high explosives, propellants, and rocket fuels.

4. The method as recited in claim 1, wherein the carrier gas is selected from the group consisting of nitrogen and argon.

5. The method as recited in claim 1, wherein the cooling step is carried out by:

passing a coolant fluid through a pathway proximate to or in heat exchange contact with the droplets.

6. The method as recited in claim 5, wherein the coolant fluid is selected from the group consisting of water and air.

7. The method as recited in claim 1, wherein step (e) is carried out by:

monitoring the temperature of the droplets next to the reactor using a thermocouple;

adjusting the coolant gas to maintain the temperature below the decomposition temperature.

8. The method as recited in claim 1, wherein step (e) comprises:

monitoring the temperature of the droplets next to the reactor using a thermocouple;

adjusting the flow of droplets to maintain the temperature below the decomposition temperature.

* * * * *